United States Patent [19]

Schönmeier

[11] 4,105,170

[45] Aug. 8, 1978

[54] PRESSURE ROLLER ARRANGEMENT

[75] Inventor: Herbert Schönmeier, Düsseldorf, Germany

[73] Assignee: Jagenberg-Werke Aktiengesellschaft, Dusseldorf, Germany

[21] Appl. No.: 817,278

[22] Filed: Jul. 20, 1977

[30] Foreign Application Priority Data

Jul. 24, 1976 [DE] Fed. Rep. of Germany ..... 2633408

[51] Int. Cl.[2] ..... B65H 17/08

[52] U.S. Cl. ..... 242/65

[58] Field of Search ..... 242/65, 66, 67.1 R, 242/67.2, 67.3 R

[56] References Cited

U.S. PATENT DOCUMENTS

| | | | |
|---|---|---|---|
| 3,232,549 | 2/1966 | Stambaugh | 242/66 |
| 3,599,889 | 8/1971 | Pfeiffer | 242/66 |
| 3,602,448 | 8/1971 | Muensterer | 242/67.1 X |
| 3,989,201 | 11/1976 | Cottrell | 242/65 |

*Primary Examiner*—Edward J. McCarthy

*Attorney, Agent, or Firm*—Burgess, Dinklage & Sprung

[57] ABSTRACT

An improvement in a pressure roller arrangement for a winding machine equipped with a winding roll onto which strip material is wound, the winding roll bearing against a support drum by means of a pair of pressure rollers which act on the winding roll to press the winding roll against a drum support. The application describes such a device in which one of the pressure rollers is connected by a swiveling lever which is supported on a cylinder piston unit and the other pressure roller is pivoted at the swiveling lever by means of a follow-up lever so that it can be moved on the first pressure roller towards and away therefrom by means of a cylinder piston unit which is supported on the swiveling lever.

2 Claims, 1 Drawing Figure

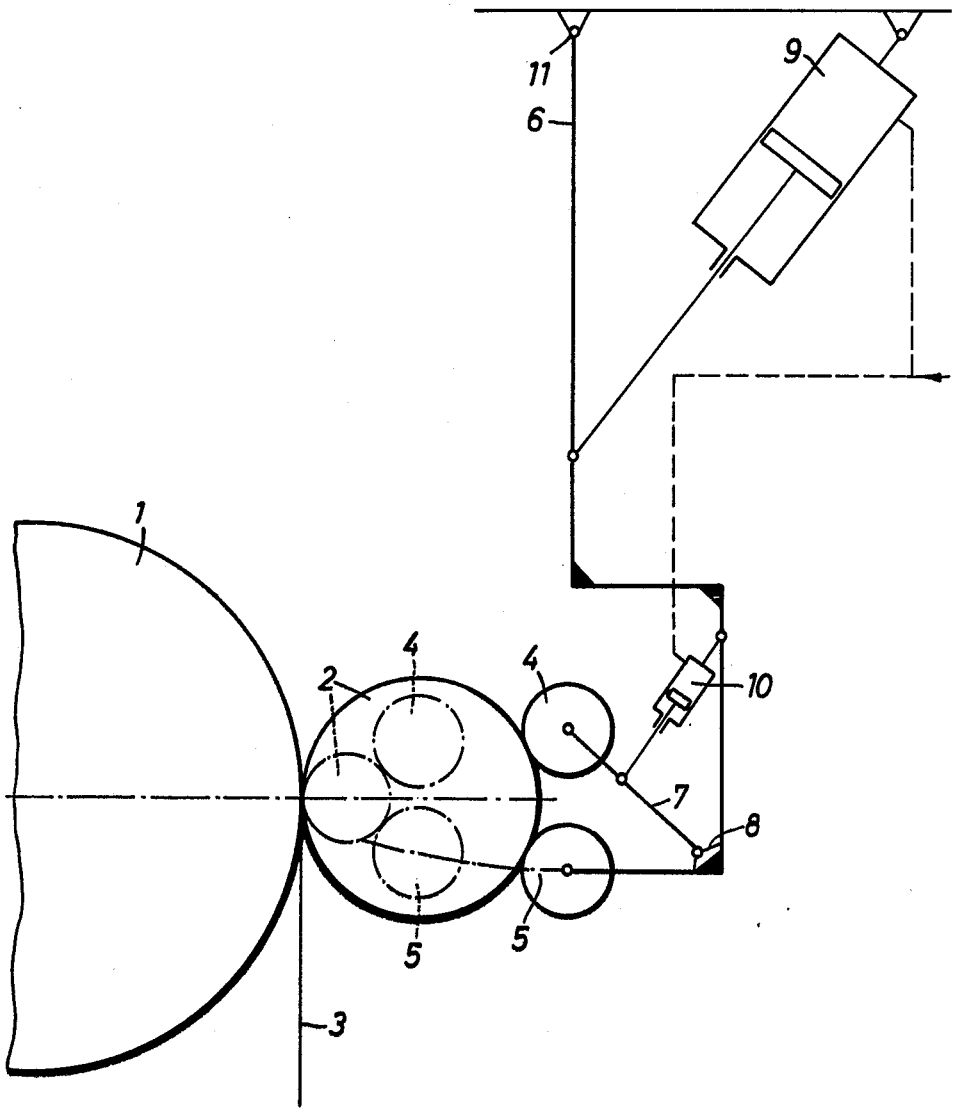
11
9
6
1
4
2
4
10
7
8
5
5
3

PRESSURE ROLLER ARRANGEMENT

BACKGROUND OF THE INVENTION

1. Field of the Invention

This invention relates to a pressure roller arrangement in a winding machine for winding up strip material, especially a pressure roller arrangement comprising a support drum for a winding roller, a winding roller on which strip material is wound, the strip material passing in the nip between the support drum and the winding roller. More especially, this invention relates to such a pressure roller arrangement wherein a pair of pressure roller acting on the winding roller to urge it toward the support drum are provided. In accordance with the invention, one of the pressure rollers is attached to a swiveling lever which is supported on a cylinder piston unit and the other pressure roller is pivoted at the swiveling lever by means of a follow-up lever so that it can be moved on the first pressure roller towards and away therefrom by means of a second cylinder piston unit which is supported on the swiveling lever.

2. Discussion of the Prior Art

The winding roll of a known winding machine with pressure roller arrangement of this type (German Offenlegungsschrift No. 2,060,758) is principally pressed against the support drum by means of the guide elements. The pair of pressure rollers thereby prevents the winding roll from bending. As both pressure rollers are inflexibly disposed at the swiveling lever here, their angle position to the generally straight path of movement of the axis of the winding roll changes during winding due to the increasing diameter of the winding roll and therewith their forces applied to the winding roll.

It is an object of this invention to provide a pressure roller arrangement of the above-mentioned type, in which both the position of the pressure rollers in the path of movement of the axes of the winding rolls and their forces applied to the winding roll remain the same during the winding process.

SUMMARY OF THE INVENTION

The objects of this invention are provided in accordance with this invention which provides an improvement in a pressure roller arrangement in a winding machine comprising a support drum and a winding roll bearing against said support drum onto which strip material is wound, said winding roller having bearing thereon on the side of said winding roller averted from said supporting roller a first pressure roll and a second pressure roll, said pressure roll connected to a first swiveling lever which is coupled at a point and connected to a first cylinder piston, said second pressure roll connected to a pivoting lever which in turn is coupled at a point to said swiveling lever and is connected to a second cylinder piston unit whereby the swiveling lever and pivoting lever are coordinated with respect to their coupling points and lengths and the cylinder piston units are coordinated with respect to their coupling points and pressure stress such that the forces applied to the winding roll by the pressure rolls in the direction of the tangents thereof to the winding roll are substantially balanced.

It is thus seen that the problems heretofore encountered are solved by providing a pair of pressure rollers, the first of which is directly disposed at the swiveling lever to which it is connected and the second is pivoted at this swiveling lever by means of a follow-up or pivoting lever and can be moved on the first pressure roller towards and away therefrom by means of a cylinder piston unit which is supported on the swiveling lever itself. By such a construction, the swiveling lever and the follow-up or pivoting lever are coordinated with respect to their coupling points and lengths and the respective cylinder piston units are coordinated with respect to their coupling points and pressure stress such that the forces applied by the pressure rollers to the winding roll in the directions of the tangents in the support point of the winding roll are substantially balanced.

With such a pressure roller arrangement the supporting forces of the support drum applied to the winding roll and the two pressure rollers which are held by the levers remain balanced during the entire winding process despite the increasing diameter of the winding roll. Therefore, no bending force can be applied to the winding roll.

According to one embodiment of the invention, the vertical of the coupling point of the swiveling lever onto the straight course fixes the end position of the horizontal swing course of the pair of pressure rollers in relation to the support drum when the winding roll is guided on a straight course, particularly on the horizontal, whereby the coupling point of the follow-up lever and the first pressure roller are situated on the side of the straight course which is averted to the coupling point of the swiveling lever.

With the foregoing embodiment of the invention, space is provided above the pair of pressure rollers for a cutting unit. If such space is not needed, the vertical of the coupling point of the swiveling lever onto the straight course can alternatively fix the beginning of the horizontal swing path of the pair of pressure rollers, whereby the first pressure roller is situated on the side of the straight course which is facing the coupling point of the swiveling lever and the second pressure roller on the averted side of the straight course. In both cases, the pressure rollers bear symmetrically upon the winding roll in relation to the straight course during their horizontal swing course.

BRIEF DESCRIPTION OF DRAWING

The invention is explained in more detail by means of a drawing representing a schematic lateral view of an embodiment.

DESCRIPTION OF SPECIFIC EMBODIMENT

A winding roll 2 of strip material 3 to be wound up, said roll at first having a small diameter, is supported on a support drum 1 of a large diameter and having fixed bearings. The winding roll 2 is held at its two front sides by guide elements (not shown), e.g., the ends of a winding mandrel which run on straight guide rails along the straight dash-line through the center of the drum and the winding roll.

The winding roll 2 is pressed on the side opposing the support drum 1 against said support drum 1 by a pair of pressure rollers 4, 5. The pressure rollers 4, 5 are positioned above or below the guide rails respectively. The lower first pressure roller 5 is fixed by its bearing on a swiveling lever 6 while the upper second pressure roller 4 is pivoted at the swiveling lever 6 by a follow-up or pivoting lever 7. The coupling point 8 of the follow-up lever 7 is situated below the straight guide rail for the winding roll 2. Both levers 6, 7, are supported on cylinder piston units 9, 10 respectively. The cylinder piston units are subjected to the same pressure by a joint pressure medium.

The dash lines in the drawing represents the pressure rollers 4, 5 at the beginning of their horizontal swing course whereas they are shown in full when at their end position. The horizontal swing course, therefore, begins between the vertical of the coupling point 11 of the swiveling lever 6 onto the straight guide rail and the support drum 1 and ends in the vertical point of the coupling point 11. The distance between the first pressure roller 5 and the straight guide rail becomes greater in this way. So that the symmetrical arrangement of the second pressure roller 4 and the balance of forces is not lost, the second pressure roller 4 is swung clockwise by the cylinder piston unit 10. The swing of the follow-up lever 7 is therefore opposed to the swing of the swiveling lever 6.

Thus, not only do the direction of the forces of the two pressure rollers 4, 5 in relation to the straight guide rails and thereby the straight path of the axis of the winding roll 2 remain symmetrical, which is to be achieved on the basis of the position of the coupling points 8, 11 of the lever arms 7, 6 and their length, but also the forces applied by the pressure rollers 4, 5 remain balanced with the same stress of pressure means of the cylinder piston units 9, 10. For this purpose, various large cylinder piston units have been chosen and the engaging points of the cylinder piston units 9, 10 at the levers 6, 7 as well as their support points have been chosen accordingly.

It is possible with the pressure roller arrangement to wind up to 250 mm working from a winding roll diameter of 100 mm, whereby the forces remain practically balanced (maximum of 3 percent deviation). Complicated control or regulating means for the swing movement and pressure stress are not needed.

What is claimed is:

1. In a pressure roller arrangement for a winding machine for winding up strip material comprising a support drum bearing against a winding roll, said winding roll being disposed within engaging guide elements on its front sides, said winding roll having bearing thereagainst on the side averted from the support drum a pair of pressure rollers acting on said winding roll between its front sides to press said winding roll against said support drum, at least one of said pressure rolls being borne by a swiveling lever which is supported on a cylinder piston unit, the improvement wherein said device comprises a first pressure roller and a second pressure roller comprising said pair of pressure rollers, said first pressure roller being directly disposed at said swiveling lever, said second pressure roller being pivoted at said swiveling lever by a follow-up lever so as to be movable on said pressure roller towards and away therefrom by means of a second piston unit which is supported on said swiveling lever.

2. A pressure roller arrangement according to claim 1 wherein said winding roll is guided on a straight course, the vertical of the coupling point for said swiveling lever onto the straight fixes the end position of the horizontal swing course of the pair of pressure rollers in relation to said support drum, the coupling point for said follow-up lever and the first pressure roller are situated on the side of the straight course which is averted to the coupling point of the swiveling lever.

* * * * *